US008112850B2

(12) United States Patent
Uehara

(10) Patent No.: US 8,112,850 B2
(45) Date of Patent: Feb. 14, 2012

(54) BUCKLE

(75) Inventor: Ryoichiro Uehara, Kurobe (JP)

(73) Assignee: YKK Corporation, Tokyo (JP)

( * ) Notice: Subject to any disclaimer, the term of this patent is extended or adjusted under 35 U.S.C. 154(b) by 196 days.

(21) Appl. No.: 12/165,901

(22) Filed: Jul. 1, 2008

(65) Prior Publication Data

US 2009/0007391 A1 Jan. 8, 2009

(30) Foreign Application Priority Data

Jul. 3, 2007 (JP) ..... 2007-175411

(51) Int. Cl.
*A44B 11/25* (2006.01)

(52) U.S. Cl. ..... 24/615; 24/625; 24/197

(58) Field of Classification Search ..... 24/614, 24/615, 625, 629, 193, 197
See application file for complete search history.

(56) References Cited

U.S. PATENT DOCUMENTS

| | | | | |
|---|---|---|---|---|
| 5,465,472 | A * | 11/1995 | Matoba | 24/625 |
| 6,148,486 | A * | 11/2000 | Uehara et al. | 24/170 |
| 7,055,226 | B2 | 6/2006 | Uehara et al. | |
| 7,140,082 | B2 * | 11/2006 | Chen | 24/625 |
| 7,181,813 | B2 * | 2/2007 | Chen | 24/625 |
| 7,302,742 | B2 * | 12/2007 | Pontaoe | 24/614 |
| 7,346,965 | B2 * | 3/2008 | Hsiao | 24/625 |
| 7,650,676 | B2 * | 1/2010 | Saitsu | 24/615 |
| 2002/0040514 | A1 * | 4/2002 | Uehara et al. | 24/614 |
| 2002/0040515 | A1 | 4/2002 | Uehara et al. | |
| 2005/0091808 | A1 | 5/2005 | Uehara et al. | |
| 2006/0090310 | A1 * | 5/2006 | Uehara et al. | 24/614 |
| 2006/0168783 | A1 * | 8/2006 | Anscher | 24/615 |
| 2007/0017074 | A1 * | 1/2007 | Pontaoe | 24/625 |
| 2007/0186394 | A1 * | 8/2007 | Hsiao | 24/614 |
| 2008/0178738 | A1 * | 7/2008 | Chan et al. | 95/141 |
| 2009/0056089 | A1 * | 3/2009 | Yoshie | 24/616 |

FOREIGN PATENT DOCUMENTS

CN 1535634 10/2004

(Continued)

OTHER PUBLICATIONS

Office Action dated Jul. 1, 2008 for Taiwan Patent Application No. TW 097124718.

(Continued)

*Primary Examiner* — Robert J Sandy
*Assistant Examiner* — Michael Lee
(74) *Attorney, Agent, or Firm* — Alston and Bird LLP

(57) ABSTRACT

A buckle includes a male member and a female member. The male member is provided with a base, a pair of legs and an engaging portion provided on a distal ends of the legs. The female member is provided with an insertion port, a guide that elastically deforms the distal end of each of the legs inserted through the insertion port in a direction in which the distal ends come closer to each other and a pair of engaged portions formed on both sides of a remote side of the guide. Each of the engaged portions displaces each of the engaging portions in the direction in which the engaging portions get apart with each other and is provided by a concave that has an abutment wall on a rear portion in the releasing direction to be abutted by each of engaging portions. Each of the abutment walls is formed as a slant surface that inclines in the direction in which the abutment walls come closer to each other toward the releasing direction of the male member.

7 Claims, 13 Drawing Sheets

FOREIGN PATENT DOCUMENTS

| | | |
|---|---|---|
| JP | H07-155207 | 6/1995 |
| JP | H08-299030 | 11/1996 |
| JP | 2594412 Y | 4/1999 |
| JP | 2002-101915 | 4/2002 |
| TW | M260136 | 4/2005 |
| TW | 1243031 | 11/2005 |
| TW | 1247591 | 1/2006 |

OTHER PUBLICATIONS

Search Report dated Dec. 1, 2011 for French Application No. 0854476.

Japanese Office Action dated Nov. 8, 2011 for Application No. JP2007-175411.

Chinese Office Action dated Nov. 10, 2011 for Application No. CN200910209017.7.

* cited by examiner

BUCKLE

BACKGROUND OF THE INVENTION

1. Field of the Invention

The present invention relates to a buckle provided with a male member and a female member. More specifically, it relates to a buckle that connects and disconnects both ends of a cord or two cords with each other.

2. Description of Related Art

A buckle disclosed in Japanese Utility Model No. 2594412 is known as a means to connect and disconnect both ends of a cord or two cords with each other.

This buckle is provided with an insertion body mounted on one of members that are to be connected with each other and a buckle body mounted on the other. The insertion body includes a pair of legs inserted into the buckle body and an engaging portion provided on each of distal ends of the pair of the legs. The buckle body is provided with an accommodating portion where the leg is inserted and an engaged portion that engages with the engaging portion of the leg.

The engaging portion of the insertion body and the engaged portion of the buckle body are engaged at engaging surfaces that have the same slant surfaces.

In other words, as shown in FIGS. 12A and 12B, an engaging surface 112 that inclines toward the inserting direction gradually from the outside to the inside is provided on an engaging portion 111 of an insertion body 110 at the rear end surface of the inserting direction of the insertion body 110. An engaged surface 122 that inclines toward the inserting direction gradually from the outside to the inside is formed on an engaged portion 121 of a buckle body 120 at the front end surface of the inserting direction of the insertion body 110.

Thus, when the insertion body 110 is inserted in the buckle body 120, the engaging portion 111 of the leg 113 abuts to the engaged portion 121 so that the leg 113 is elastically deformed inward (see the condition in FIG. 12A). When the insertion body 110 is further inserted into the buckle body 120 so that the engaging portion 111 goes over the engaged portion 121, the leg 113 is elastically deformed outward so that the engaging surface 112 is engaged with the engaged surface 122 (see the condition in FIG. 12B). Accordingly, the insertion body 110 is engaged with the buckle body 120.

In the buckle disclosed in Japanese Utility Model No. 2594412, in the condition in FIG. 12B, when the tensile force (i.e., the force in a direction opposite to the inserting direction) is applied on the insertion body 110 and the buckle body 120, the engaging intensity between the insertion body 110 and the buckle body 120 can be enhanced since the engaging surface 112 and the engaged surface 122 are slanted. However, shakiness is generated between the insertion body 110 and the buckle body 120 under the condition where the insertion body 110 is engaged with the buckle body 120.

In other words, the insertion body 110 needs to be inserted until the position where the engaging portion 111 goes over the engaged portion 121 in order for the engaging portion 111 to be engaged with the engaged portion 121. Once the engaging portion 111 goes over the engaged portion 121, the leg 113 is elastically deformed outward and the engaging surface 112 and the engaged surface 122 are engaged with each other at a position where the insertion body is slightly returned in a releasing direction. Accordingly, the inserting direction dimension L that corresponds to the slant of the engaging surface 112 and the engaged surface 122 becomes a factor that generates shakiness between the insertion body 110 and the buckle body 120. Such shakiness causes an impact noise and harms the quality thereof.

SUMMARY OF VARIOUS EMBODIMENTS OF THE INVENTION

An object of various embodiments of the invention is to provide a buckle that solves the above problems and prevents shakiness between a male member and a female member.

A buckle according to one embodiment of the present invention includes: a male member and a female member, in which: the male member includes: a base; a pair of legs that project from the base; and an engaging portion provided on a distal end of each of the pair of the legs to be engageable with the female member; the female member includes: an insertion port into which the pair of the legs of the male member are inserted; a guide that elastically deforms the pair of the legs inserted through the insertion port in a direction in which the distal ends of the pair of the legs come closer to each other; and a pair of engaged portions that displaces the distal ends of the pair of the legs in a direction in which the distal ends of the pair of legs are spaced apart from each other to be engaged with each of the engaging portions when the male member is inserted to a predetermined position; each of the engaged portions are oppositely provided in the direction for the legs to be spaced apart from each other, the engaged portions respectively have an abutment wall that abuts each of the engaging portions; and the abutment walls are respectively formed as a wall surface that extends in a direction in which each of the walls comes closer to each other toward a releasing direction of the male member.

In the above, a slant surface (tapered surface) and an arc may be, for example, used to form each of the abutment walls as a wall surface that extends in the direction in which the wall surface comes closer to each other toward a releasing direction of the male member.

According to the above arrangement, when the pair of the legs of the male member are inserted through the insertion port, the guide elastically deforms the distal ends of the pair of the legs in the direction in which the distal ends come closer to each other. Once the male member is inserted to the predetermined position, each of the engaging portions is moved in the direction to be away from each other by elastic recovering force of the pair of the legs to be abutted each of the abutment walls oppositely disposed in the direction to be away from each other.

Each of the abutment walls is formed as a wall that extends in the direction in which the abutment walls come closer to each other toward the releasing direction of the male member (e.g. the abutment wall of the engaged portion for the engaging portion to be abutted is formed as a slant surface), the engaging portions can be securely contacted with the engaged portions. Accordingly, since no clearance is generated between the engaging portion and the engaged portion, shakiness caused by the clearance can be prevented.

At this time, since each of the engaging portions abuts each of the abutment walls while being urged in the direction to be away from each other by the elastic restoring force of each of the legs and each of the abutment walls are formed as walls that extend in the direction in which each of the abutment walls come closer to each other toward the releasing direction of the male member, no clearance is generated in the inserting direction of the male member and in a direction orthogonal to the inserting direction of the male member in which the pair of the legs elastically deform. Therefore, shakiness in these two directions can be prevented.

Further, since each of the engaging portions abut each of the abutment surfaces while being urged in a direction to be away from each other (i.e. each of the engaging portions abuts on the walls that extend in the direction in which each of the engaging portions come closer to each other toward the releasing direction of the male member), resistance against the releasing direction of the male member can be generated to maintain the engaging force between the male member and the female member.

In the above arrangement, an abutment portion of the engaging portion which abuts to each of the abutment walls may preferably extend in a direction in which the abutment portion comes closer to each other toward the releasing direction of the male member and is formed as a wall surface that substantially coincides with the wall surface of each of the abutment walls.

In the above, since the abutment portion of the engaging portion which abuts on each of the abutment walls is also formed as a wall surface that substantially coincides with the wall surface of each abutment wall, the abutment wall of the engaged portion and the abutment portion of the engaging portion can be brought into face-to-face contact to maintain the resistance against the releasing direction of the male member. Thus, the engaging force between the male member and the female member can also be kept higher.

In the above arrangement, each of the engaged portions may include an engaged wall that is consecutively formed on a side of the insertion port of the abutment wall and substantially orthogonal to the inserting direction of the male member; and each of the engaging portions may preferably include an engaging wall that is consecutively formed on an end of the base side of the abutment portion, substantially orthogonally crosses with respect to the releasing direction of the male member and is engaged with the engaged wall.

In this arrangement, when a force of releasing direction affects the male member and the female member while the male member and the female member are engaged with each other, the abutment portion of the engaging portion is moved along the slant surface of the abutment wall of the engaged portion so that the engaging wall of the engaging portion is engaged with the engaged wall of the engaged portion.

Since the engaging wall of the engaging portion and the engaged wall of the engaged portion are formed as walls substantially orthogonal to the inserting direction of the male member, the force in the releasing direction applied on the male member and the female member can be securely absorbed by these engaging wall and the engaged wall. Thus, the male member and the female member are not easily disengaged by the force of the releasing direction applied on the male member and the female member.

In the above arrangement, a butting portion whose central portion more projects toward a projecting direction of the legs than both side portions where the legs project may preferably be provided on the base of the male member; and a butting portion that is provided on a side of the insertion port to closely contact with the butting portion of the male member is provided on the female member.

In the above, when the male member is inserted in the female member, the butting portion of the male member closely touches with the butting portion of the female member, which results in a simple design and less shakiness.

A buckle according to another embodiment of the invention includes: a male member; and a female member, where the male member comprises: a base; a pair of legs that project from the base; an engaging portion provided on a distal end of each of the pair of the legs to be engageable with the female member; and an elastic connecting code connected between inner sides of the pair of the legs; the female member comprises: an insertion port into which the pair of the legs of the male member are inserted; and a pair of engaged portions that are engaged with each of the engaging portions when the pair of the legs inserted through the insertion port are inserted to a predetermined position; the base is provided by a frame including a cord attachment hole therein, a central portion of a frame material of the frame on which the pair of legs are provided is protruded in a direction for the pair of the legs are protruded relative to both ends thereof, and a central portion of the connection code is convexly curved toward the frame material.

In the buckle according to the above embodiment of the invention, the frame material is preferably provided as a butting portion against the female member and the butting portion is preferably formed in a V-shape in which a central portion of the frame material protrudes in the projecting direction of the leg relative to the both ends of the frame material.

In the buckle according to the above embodiment of the invention, the connection code is preferably formed in a reverse U-shape of which central portion is curved in a convex shape toward the frame material.

When a male member has a base including a cord attachment hole therein and a pair of legs protruding from the base as in a conventional buckle, since the opening of the cord attachment hole is small, it is difficult to insert a cord into the cord attachment hole. Further, when a tensile force is applied on the pair of legs (e.g. when external force for biasing the pair of legs outward or when a foreign material enters in between the pair of legs to deform the pair of legs outward), the legs are likely to be damaged.

According to the above embodiment of the invention, since the base includes the frame having a cord attachment hole thereinside and the frame material of the frame provided with the leg is protruded in the projecting direction of the legs at the center thereof relative to both ends, the opening of the cord attachment hole within the frame can be widened, which facilitates inserting operation of the cord into the cord attachment hole.

Further, since the inner sides of the pair of legs are connected by the elastic connecting code, unexpected deformation of the pair of legs toward the outside can be avoided, which prevents deformation of the legs when excessive tensile force (tensile force toward the outside) is applied on the legs. Further, since the connecting code is convexly curved in a direction for the central portion thereof to come close to the frame material of the base, i.e. since the space between the central portion of the frame material and the central portion of the connecting code is narrowed, foreign material is not likely to enter into the space, which prevents invasion of the foreign material into the space to deform the legs toward the outside.

DETAILED DESCRIPTION OF VARIOUS EMBODIMENTS OF THE INVENTION

An embodiment of the present invention will be described below with reference to drawings.

Figure 1:
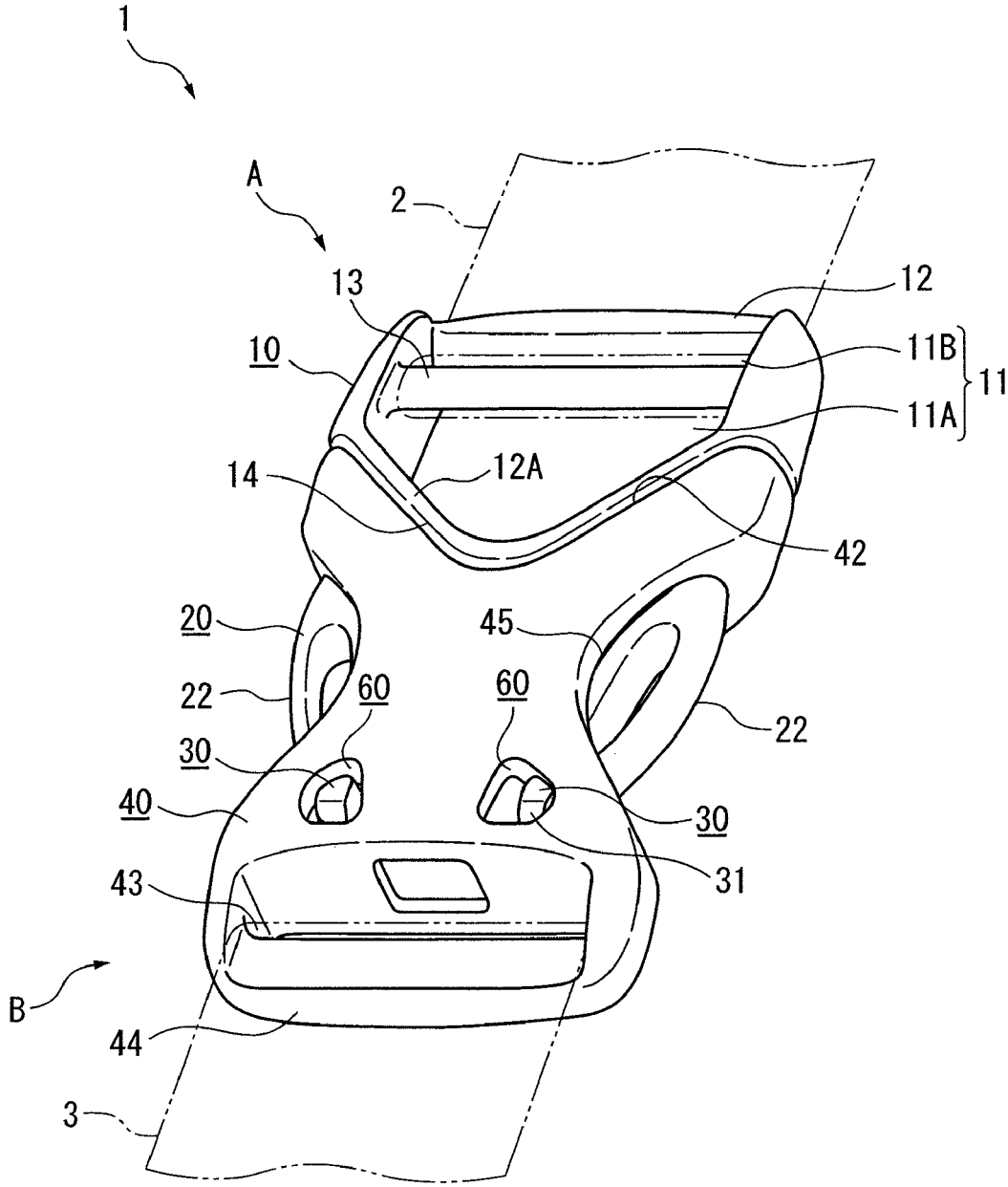
FIG. 1 is a perspective view showing a buckle of an embodiment of the present invention.
Figure 2:
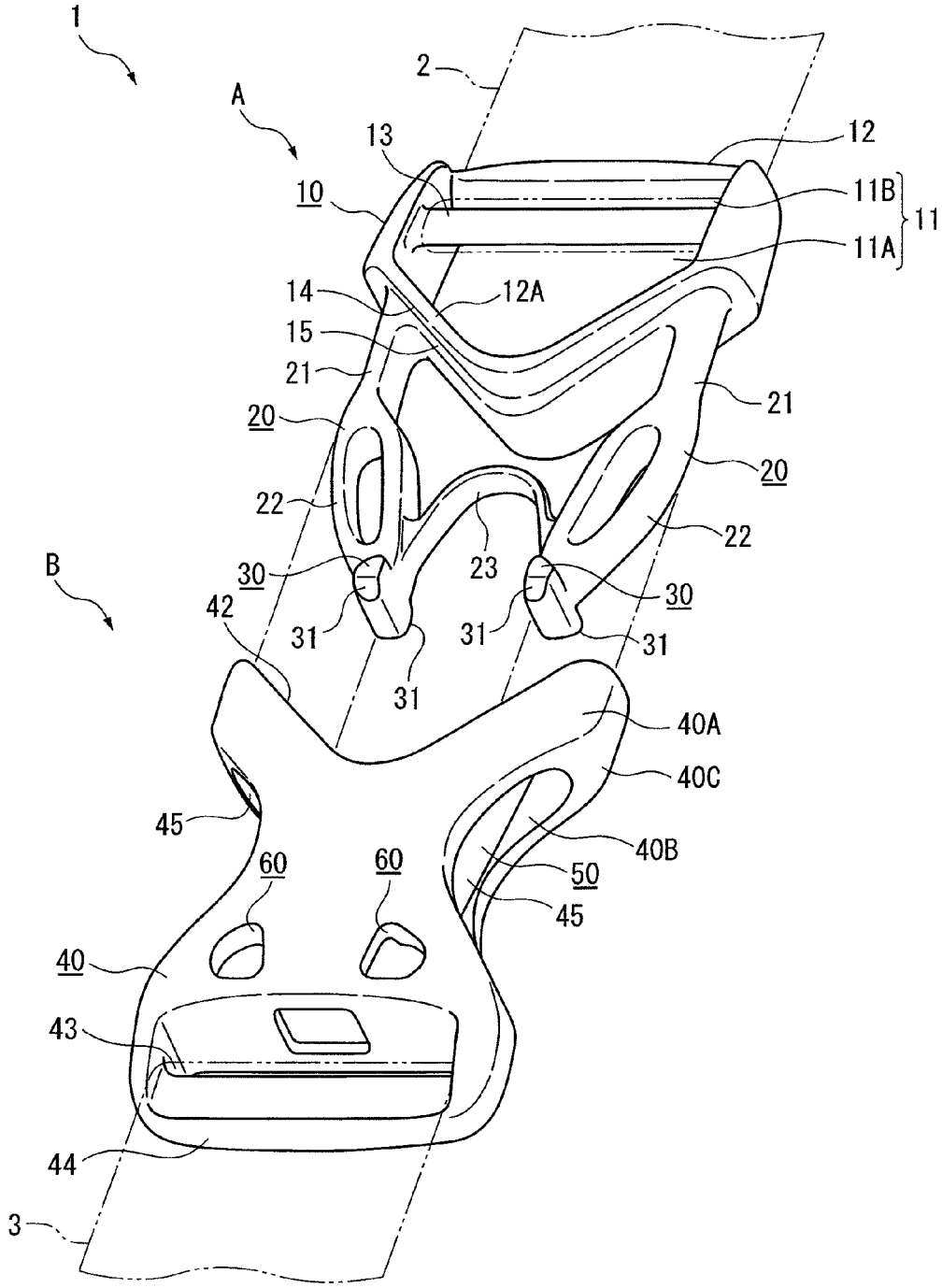
FIG. 2 is an exploded perspective view showing the disengaged buckle of the embodiment.
Figure 3A:
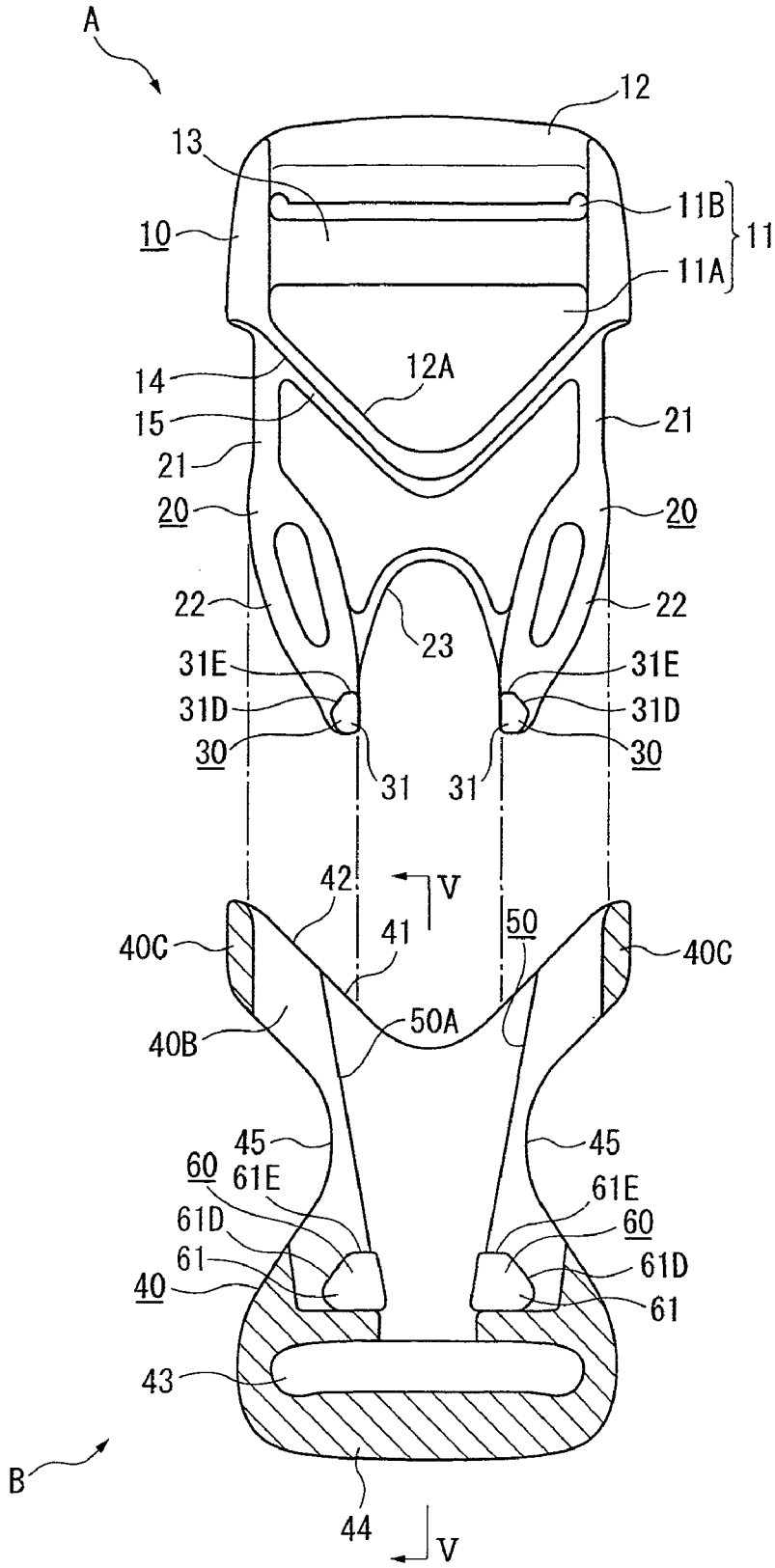
FIG. 3A is a partially-sectional plan view showing the disengaged buckle of the embodiment.
Figure 3B:
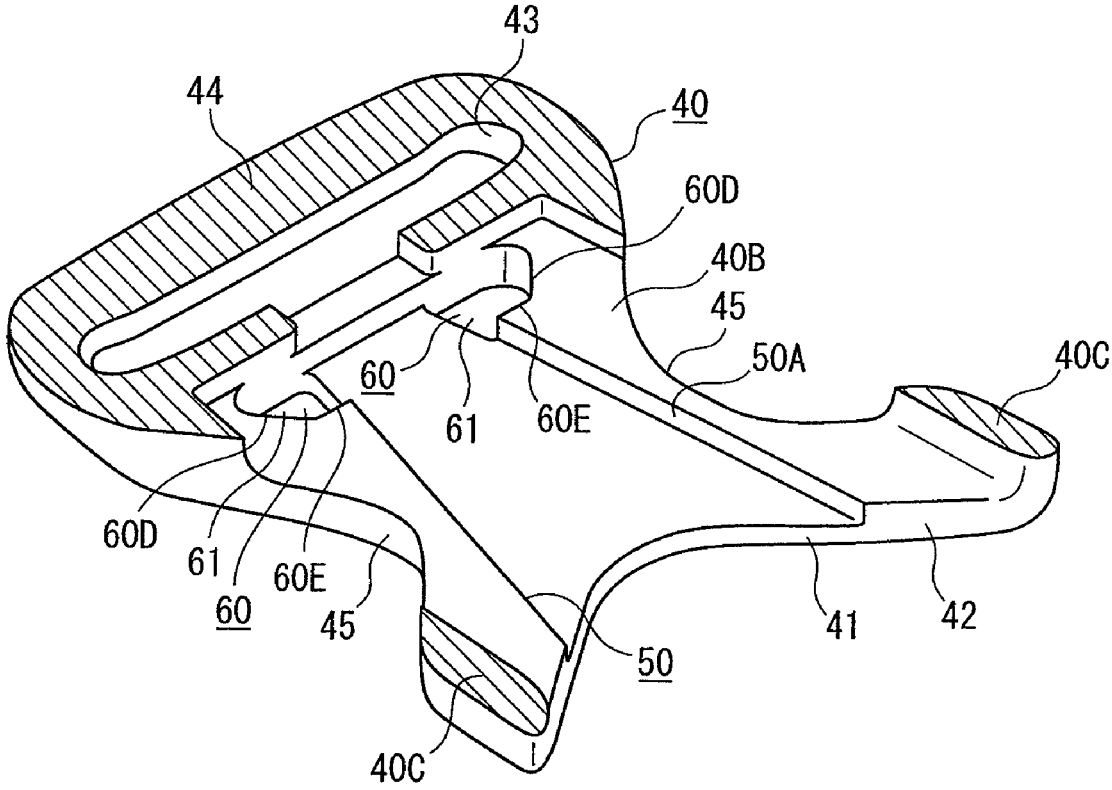
FIG. 3B is a partially-sectional perspective view of the female member of the embodiment.

FIG. 1 is a perspective view showing a buckle of the embodiment. FIG. 2 is a perspective view showing the disengaged buckle of the embodiment. FIG. 3A is a partially-sectional plan view showing the disengaged buckle of the embodiment. FIG. 3B is a partially-sectional perspective view of the female member.

As shown in FIGS. 1-3A,B, a buckle 1 of the present embodiment is for connecting and disconnecting end portions 2 and 3 of a cord, which is provided with a male member A integrally molded of synthetic resin and a female member B similarly integrally molded of synthetic resin into which the male member A is inserted to be engaged. Materials of the male member A and the female member B are not limited to synthetic resin but may be other material such as metal.

The male member A is provided with: a base 10; a pair of legs 20 that project from the both sides in the width direction (a direction orthogonally crossing the inserting direction of the male member A) of the base 10 toward the length direction (the inserting direction of the male member A) in parallel with each other; and are elastically deformable in directions where the pair of the legs 20 come closer or get apart with each other and an engaging portion 30 provided on each distal end of the pair of the legs 20 and engageable with the female member B.

The base 10 is constituted by a substantially pentagonal frame 12 that has a cord attachment hole 11 (a cord attachment portion) where the end portion 2 of the cord is inserted to be engaged at an inner central position.

A connecting bar 13 is built across the width direction of the frame 12 at the middle position of the cord attachment hole 11. The connecting bar 13 devides the cord attachment hole 11 into two cord attachment holes 11A and 11B respectively provided on the front end of the inserting direction (an end provided with the legs 20) and on the opposed rear end of the inserting direction. Accordingly, the length of the cord can be adjusted by inserting the cord into the cord attachment holes 11A and 111B to wind around the connecting bar 13.

The cord attachment hole 11A exhibits substantially pentagonal shape that extends toward the projecting direction of the pair of legs 20 while gradually decreasing width dimension (i.e. dimension in a direction orthogonal to the projecting direction of the leg 20) thereof.

Of the frames 12, a frame material 12A on which the legs 20 are provided is formed as a butting portion 14 that butts the female member B. The butting portion 14 is formed in a V-shape in which the center portion projects further toward the projecting direction of the legs 20 than the both ends of the frame material 12A. The butting portion 14 has a fitting convex 15 which has a slightly smaller profile than the outer circumferential profile of the frame material 12A and slightly projects in the projecting direction of the legs 20 on the surface on which the legs 20 of the frame material 12A is provided.

Each of the legs 20 includes an elastic piece 21 that linearly extends in the inserting direction of the male member A from each side of the base 10 and is elastically deformable in directions where both of the elastic pieces 21 come closer or get apart with each other and a guide piece 22 that extends from the distal end of the elastic piece 21 in the inserting direction of the male member A.

The elastic piece 21 has a cross-section in which the dimension (width dimension) in the elastically deforming direction is smaller than that of the front-back direction.

The guide piece 22 is bifurcated from the elastic piece 21 and jointed at the distal end while the outer surface of the guide piece 22 is curved inward toward the distal end (i.e. the direction in which each of the legs 20 come closer to each other). An elastic connecting cord 23 connects each of the inner surfaces of a pair of the guide pieces 22. The connecting cord 23 is reversed-U-shaped component that convexly curves toward the frame material 12A to prevent the pair of the guide piece 22 from deforming more outward than a predetermined level so that the legs 20 are protected from damages generated by an excessive tensile force (tensile force to the outside) imposed on the legs 20.

The engaging portion 30 is constituted by a projection 31 that projects toward the top and bottom sides of the distal end of the guide piece 22 of each of the pair of the legs 20.

Figure 4:
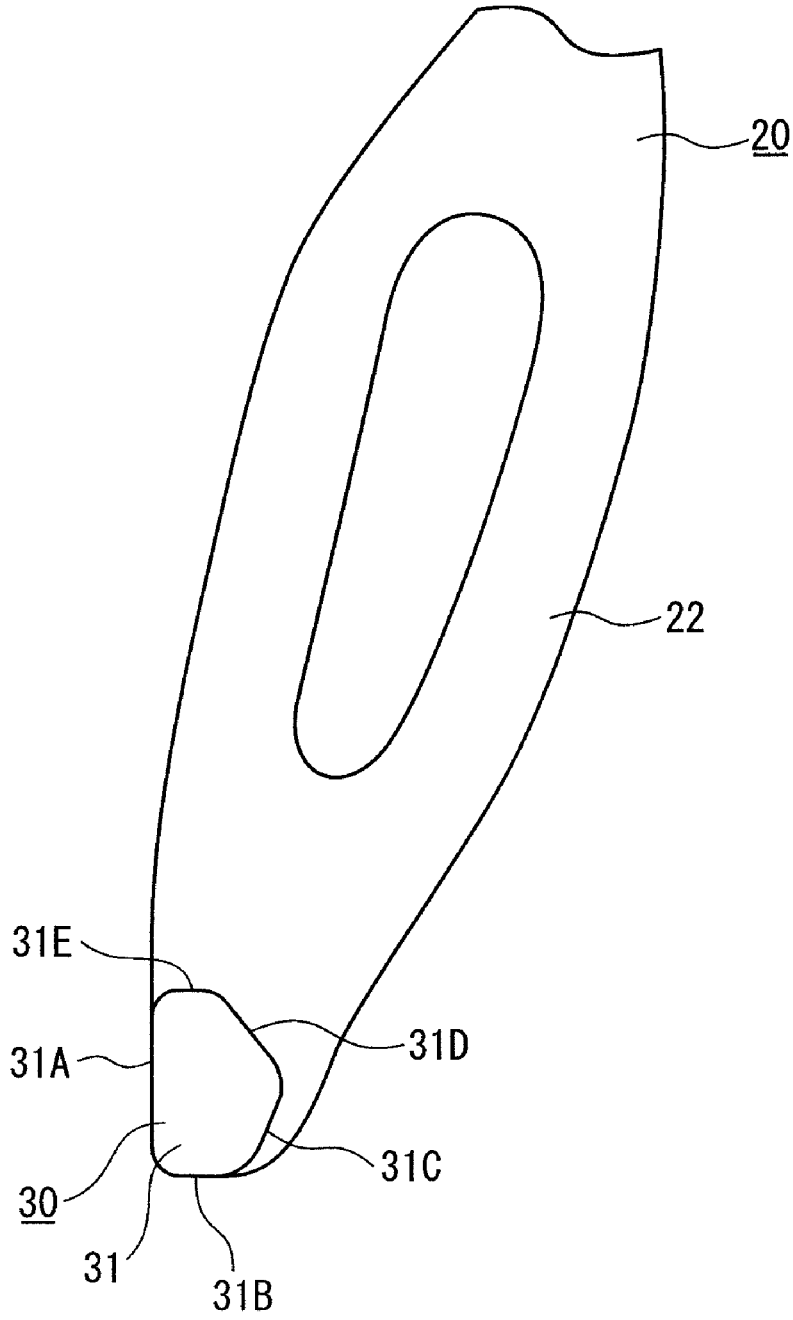
FIG. 4 is an enlarged view showing a part around an engaging portion of a male member in the embodiment.

The projection 31 includes, as shown in FIG. 4, peripheral walls such as an inner side wall 31A, a front side wall 31B, a front outer side wall 31C, a back outer side wall 31D and a back side wall 31E while being substantially pentagonal in which corner portions of neighboring walls are connected by circular surfaces. The inner side wall 31A is positioned on the inner surface of the guide piece 22 and formed as a wall substantially parallel to the inserting direction of the male member A. The front side wall 31B is formed as a wall substantially orthogonally crossing the inserting direction of the male member A. The front outer side wall 31C is formed as a slant surface gradually distanced from the inner side wall 31A toward the releasing direction of the male member A from the front side wall 31B. The back outer side wall 31D is formed as a slant surface that comes gradually closer to the inner side wall 31A toward the releasing direction of the male member A from the front outer side wall 31C. More specifically, the slant surface is formed to make 45-degree angle relative to the inner side wall 31A. The front outer side wall 31C and the back outer side wall 31D are positioned on the opposite side of the inner side wall 31A (i.e. on the outer surface side of the guide piece 22). The back side wall 31E is a surface that faces back and forth to the front side wall 31B in the inserting direction of the male member A, which is formed as a wall substantially orthogonally crossing with respect to the inserting direction of the male member A.

In other words, each of a pair of the projections 31 is substantially pentagonal, which includes the back outer side wall 31D (abutment wall) formed on the slant surface that inclines toward the direction in which both of the projections 31 come closer and the back side wall 31E (engaging wall) substantially orthogonally crossing with the inserting direction of the male member A and consecutively formed from the end of the base 10 side of the back outer side wall 31D.

Figure 5:
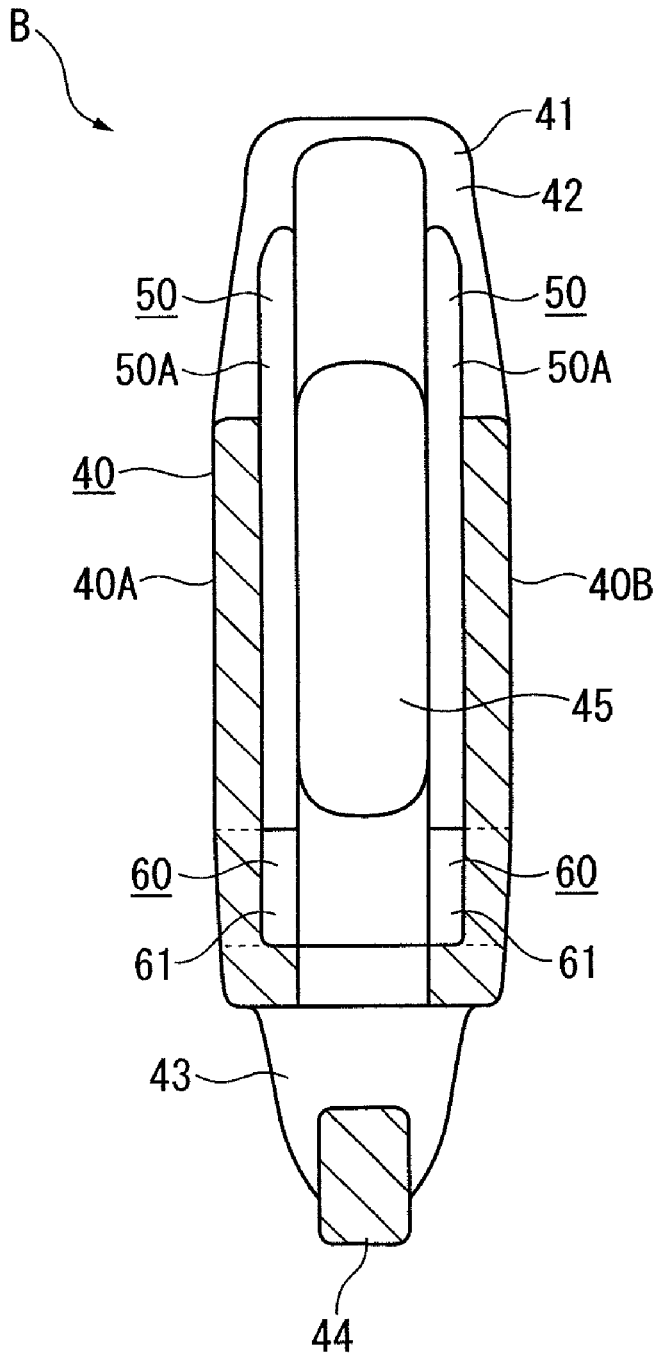
FIG. 5 is an enlarged cross-section taken along V-V line in FIG. 3A.

The female member B is provided with, as shown in FIG. 5, a flat cylindrical female member body 40 that includes a top wall 40A and a bottom wall 40B which constitute the top and bottom surfaces and a pair of side walls 40C that connect the top wall 40A and the bottom wall 40B.

An insertion port 41 in which the pair of the legs 20 of the male member A is inserted and a butting portion 42 that butts the butting portion 14 of the male member A are provided on a first end of the female member body 40. The butting portion 42 is formed in V-shape that corresponds to the butting portion 14 of the male member A and the insertion port 41 is formed to fit with the fitting convex 15 of the male member A.

A cord attachment hole 43 and a connecting bar 44 (cord attachment portions) where the end portion 3 of the cord is inserted and engaged are formed on a second end of the female member body 40. An opening 45 concavely cut out toward the inside of the top wall 40A and the bottom wall 40B is formed at the middle portion of the side wall 40C. Each of the guide pieces 22 provided on each of the legs 20 of the male member A is exposed from the opening 45 so that both of the guide pieces 22 can be operably pushed inward with each other. In other words, the guide piece 22 also works as an operating portion that releases the male member A from the female member B.

A guide 50 that is formed from the insertion port 41 toward the inside of the female member body 40 and elastically deforms each of the distal ends of the pair of the legs 20 in the direction in which each of the distal ends come closer to each other while guiding the engaging portion 30 and a pair of engaged portions 60 provided on the both sides of the rear side of the guide 50 to be engaged with each of the engaging portions 30 are provided on the inside of the female member body 40.

The guide 50 is constituted by a tapered guide groove 50A whose width becomes gradually narrower from the insertion port 41 to the engaged portion 60 at the inner surface of the top wall 40A and the bottom wall 40B of the female member body 40.

The engaged portion 60 is formed by a concave 61 that shifts each of the engaging portions 30 to the direction in which the engaging portions get apart with each other.

Figure 6:
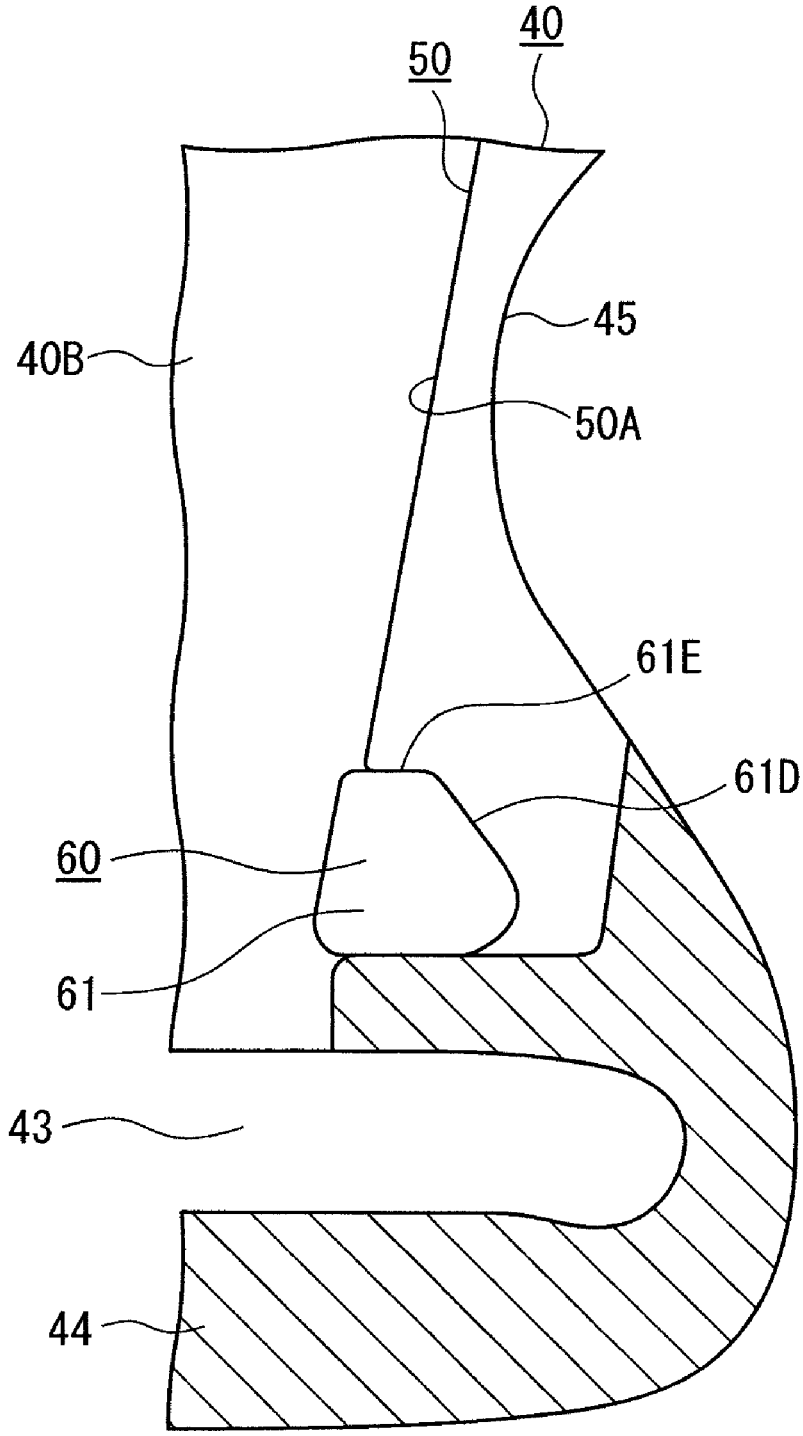
FIG. 6 is an enlarged view showing a part around an engaged portion of a female member in the embodiment.

The concave 61 is, as shown in FIG. 6, formed as a substantially pentagonal concaved groove formed by cutting the inner surfaces of the top wall 40A and the bottom wall 40B of the male member body 40 from the rear portion of the guide groove 50A toward a substantially orthogonally crossing direction with respect to the inserting direction of the male member A to the both outsides. In other words, a butting wall of the concave 61 is placed on the rear portion in the releasing direction of each engaging portion 30. The concave 61 is substantially pentagonal including an abutment wall 61D on the butting wall on which each engaging portion 30 abuts and an engaged wall 61E consecutively formed on an end of the abutment wall 61D near the insertion port 41.

The abutment walls 61D are formed as slant surfaces that incline toward the direction in which the abutment walls 61D come closer to each other toward the releasing direction of the male member A. Specifically, the slant surfaces have substantially the same slant as those of the back outer side walls 31D of the engaging portions 30 so as to abut to those of the back outer side walls 31D of the engaging portions 30. The engaged wall 61E is a wall with which the back side wall 31E of the engaging portion 30 is engaged, which is formed as a wall surface that substantially orthogonally crosses the inserting direction of the male member A. Further, the concave 61 formed on the top wall 40A and the concave 61 formed on the bottom wall 40B are respectively opened at the outer surface of the top wall 40A and the outer surface of the bottom wall 40B.

Figure 7:
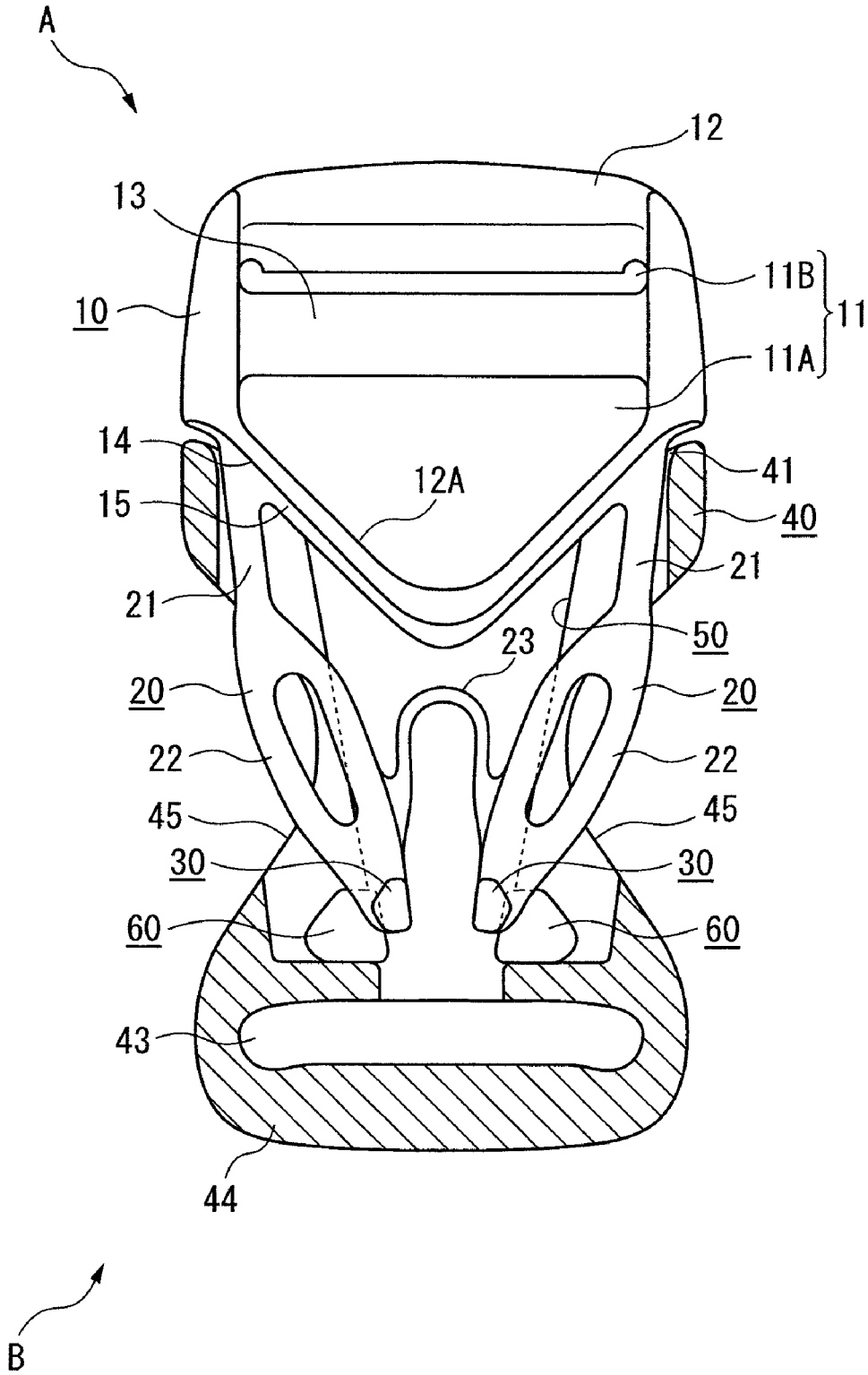
FIG. 7 is a cross-section showing a condition where the male member is in the middle of being inserted into the female member in the embodiment.
Figure 8:
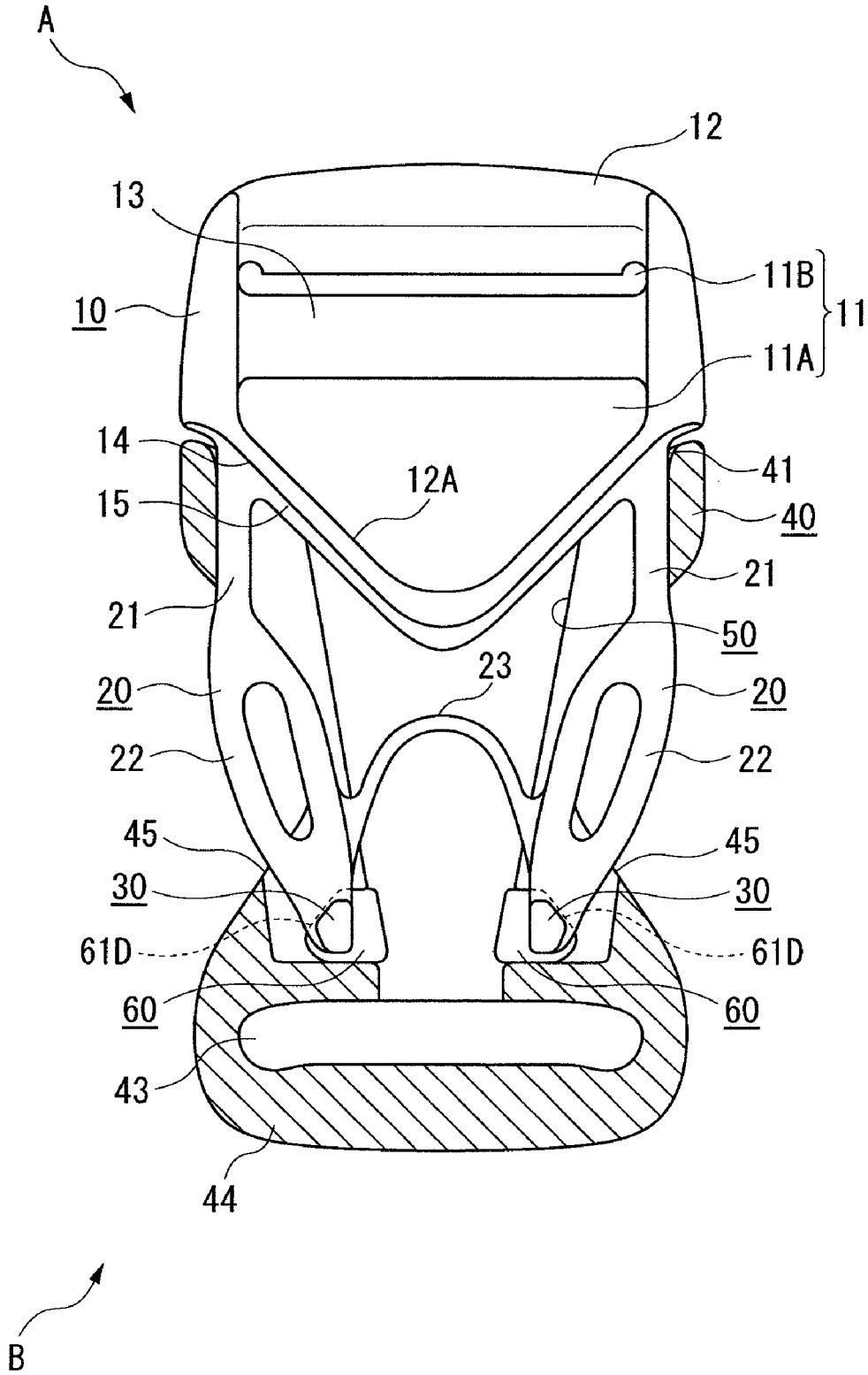
FIG. 8 is a cross-section showing a condition where the male member has been inserted into the female member in the embodiment.
Figure 9:
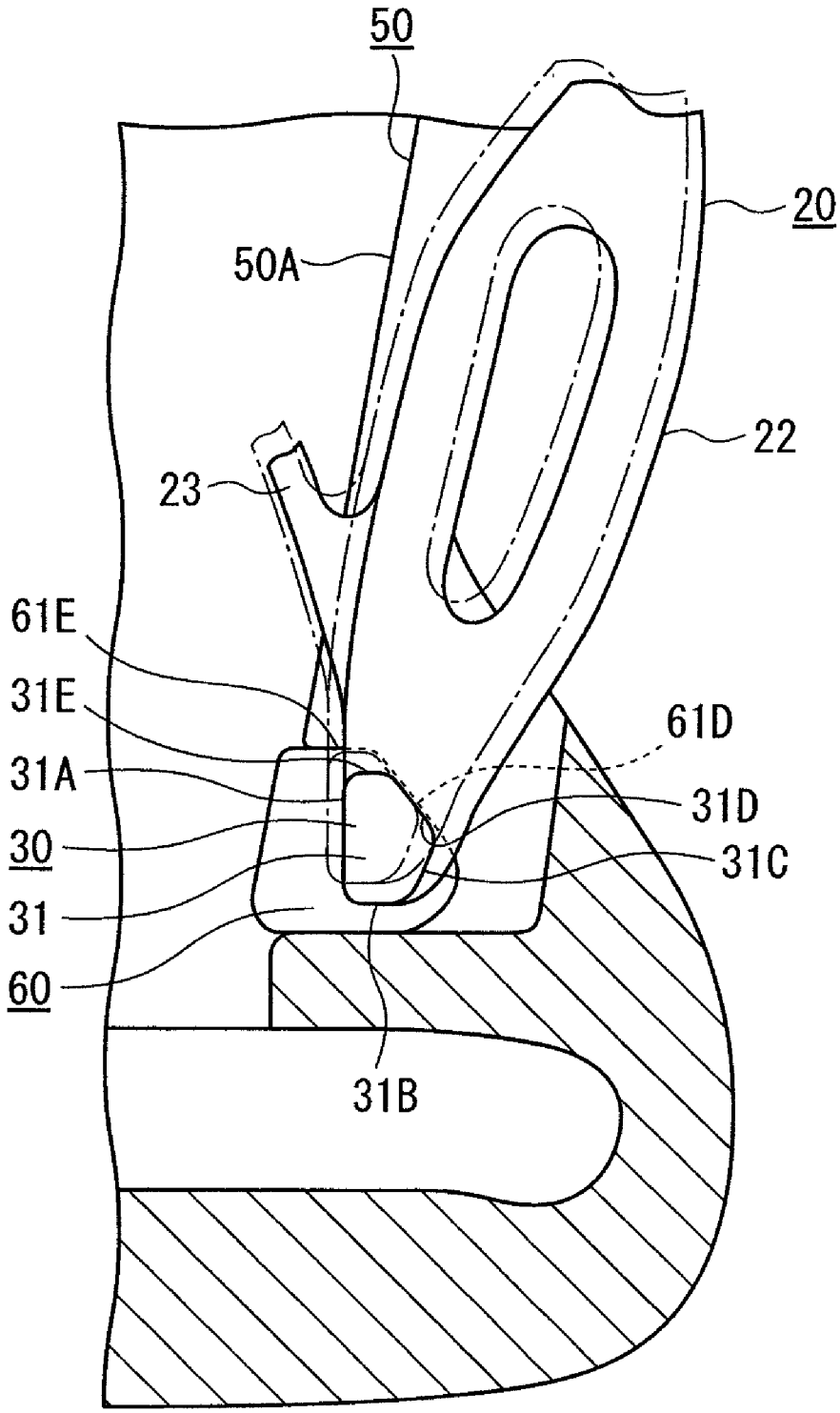
FIG. 9 is a view showing a condition where a tensile force is applied on the male member and the female member in the embodiment.

When the pair of the legs 20 of the male member A is inserted through the insertion port 41 of the female member B, as shown in FIG. 7, the engaging portions 30 provided on each of the distal ends of the legs 20 are inserted into the inside of the female member B while being guided by the guide groove 50 and the distal ends of the pair of the legs 20 are elastically deformed in the direction in which the distal ends come closer to each other. Then, once the engaging portions 30 reach the engaged portions 60 over the guide groove 50A, as shown in FIG. 8, each of the engaging portions 30 is displaced to be away from each other by the elastic restoring force of the pair of the legs 20 to be abutted to the abutment wall 61D while pressing the abutment wall 61D at the remote side in the releasing direction.

Each of the abutment walls 61D is formed as a slant surface that inclines in the direction in which each of the abutment walls 61D comes closer to each other toward the releasing direction of the male member A (i.e., the abutment surfaces 61D of the engaged portions 60 to which the engaging portions 30 abut are formed as slant surfaces), the engaging portions 30 can be securely contacted with the engaged portions 60. Accordingly, since there is no clearance between the engaging portion 30 and the engaged portion 60, shakiness caused by the clearance can be prevented.

At this time, each of the engaging portions 30 abuts to each of the abutment walls 61D while being urged in the direction in which each of the engaging portions 30 get apart from each other by the elastic restoring force of each of the legs 20 and each of the abutment walls 61D is formed as a slant surface that inclines in the direction in which each of the abutment walls 61D comes closer to each other toward the releasing direction of the male member A. Accordingly, there is no clearance also in the inserting direction of the male member A and the direction orthogonal to the inserting direction of the male member A, in which the pair of the legs 20 elastically deform. Therefore, shakiness in these two directions can be prevented.

Further, since each of the engaging portions 30 abut each of the abutment walls 61D while being urged in a direction to be apart from each other (i.e. each of the engaging portions 30 abuts the slant surface that inclines in the direction in which each of the engaging portions 30 comes closer to each other toward the releasing direction of the male member A), resistance can be applied in the releasing direction of the male member A to maintain the engaging force between the male member A and the female member B.

In the present embodiment, since the back outer side wall 31D of the engaging portion 30 which abuts to each of the abutment walls 61D is also formed as a slant surface that substantially corresponds to the slant surface of each abutment wall 61D, the abutment wall 61D of the engaged portion 60 and the back outer side wall 31D of the engaging portion 30 can be brought into face-to-face contact to maintain the resistance in the releasing direction of the male member A. Thus, the engaging force between the male member A and the female member B can also be kept higher.

In addition, when a force in releasing direction affects the male member A and female member B while the male member A and the female member B are engaged with each other, the back outer side wall 31D of the engaging portion 30 is moved along the slant surface of the abutment wall 61D of the engaged portion 60 so that the back side wall 31E of the engaging portion 30 is engaged with the engaged wall 61E of the engaged portion 60. At this time, the connecting cord 23 that bridges between the inner surfaces of both of the guide pieces 22 suppress the inward deformation of the leg 20 to keep the engagement between the back side wall 31E of the engaging portion 30 and the engaged wall 61E of the engaged portion 60.

Since the back side wall 31E of the engaging portion 30 and the engaged wall 61E of the engaged wall 60 are formed as walls that substantially orthogonally cross the inserting direction of the male member A, the force in the releasing direction which affects the male member A and the female member B can be securely received by these back side wall 31E and the engaged wall 61E. Thus, the male member A and the female member B are not easily disengaged by the force in the releasing direction applied on the male member A and the female member B.

When the male member A is inserted into the female member B, the butting portion 14 of the male member A closely touches with the butting portion 42 of the female member B, which gives simple appearance to the holder. Since the male member A and the female member B can be engaged while being closely contacting with each other, shakiness therebetween can be further effectively prevented.

To release the male member A from the female member B, the outside surface of the guide piece 22 of the leg 20 projecting from the opening 45 of the female member B is pressed inward. The leg 20 of the male member A is accordingly elastically deformed inward to release the engaging portion 30 from the engaged portion 60. When the male member A is disengaged from the female member B in this condition, the male member A can be released from the female member B.

The present invention is not limited to the buckle described in the above embodiment, but includes the following modifications.

In the above embodiment, the engaging portion 30 is constituted by the substantially pentagonal projection 31 and the engaged portion 60 is constituted by the substantially pentagonal concave 61. However, they are not limited to the combination of the pentagonal projection and concave.

For example, the engaging portion 30 may be any polygon having the back outer side wall 31D (abutment portion) and the back side wall 31E (engaging wall) on adjoining sides thereof. The engaged portion 60 may be any polygon having the abutment wall 61D and the engaged wall 61E on adjoining sides thereof.

In the above embodiment, the back outer side wall 31D (abutment portion of the engaging portion 30) is formed as a slant surface that makes a substantially 45 degree angle with respect to the inner side wall 31A. However, the angle is not limited thereto. For example, the angle may be selected within the range of about 30 to about 60 degrees.

Similarly, as for the abutment wall 61D of the engaged portion 60, the angle may be selected within the range of about 30 to about 60 degrees.

Figure 10:
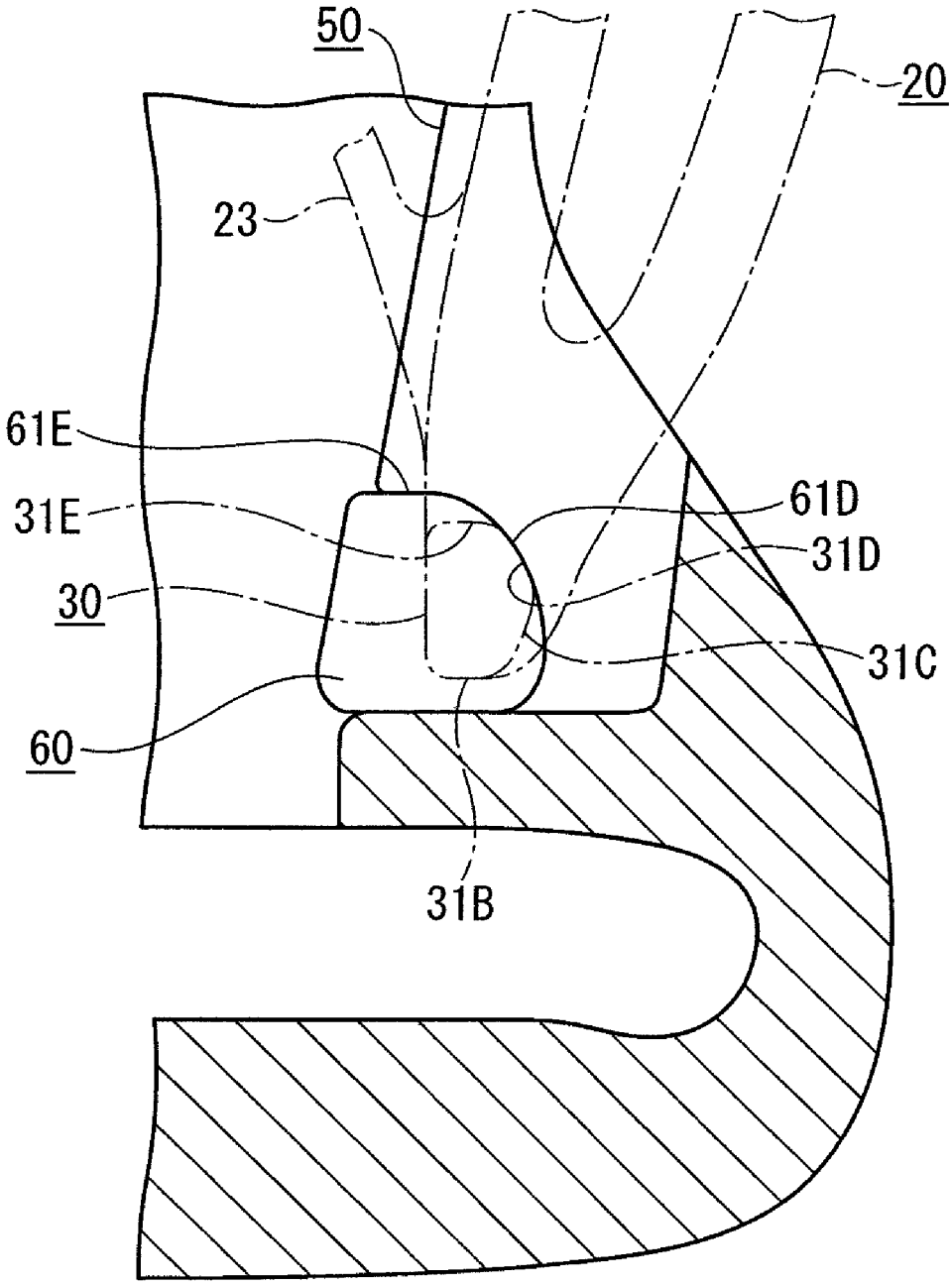
FIG. 10 is an exploded view showing a modification of a part around the engaged portion of the female member.

Accordingly, as shown in FIG. 10, both of the abutment wall 61D of the engaged portion 60 and the back outer side wall 31D (abutment portion of the engaging portion 30) may be formed as arcs that have substantially the same curvature. In other words, the same advantages can be expected by the circular surfaces, which curve in the direction in which the arcs come closer with each other toward the releasing direction of the male member A and show a convex profile seeing from the center of the concave 61 and the engaging portion 30.

In the above embodiment, the guide groove 50A is formed on the inside of the female member body 40 from the insertion port 41 toward the engaged portion 60 so that the guide groove 50A guides the engaging portion 30 while elastically deforming the distal ends of the pair of the legs 20 in the direction in which the distal ends come closer to each other. However, the guide 50 that elastically deforms the distal ends of the pair of the legs 20 in the direction in which the distal ends come closer to each other is not limited thereto.

Figure 11:
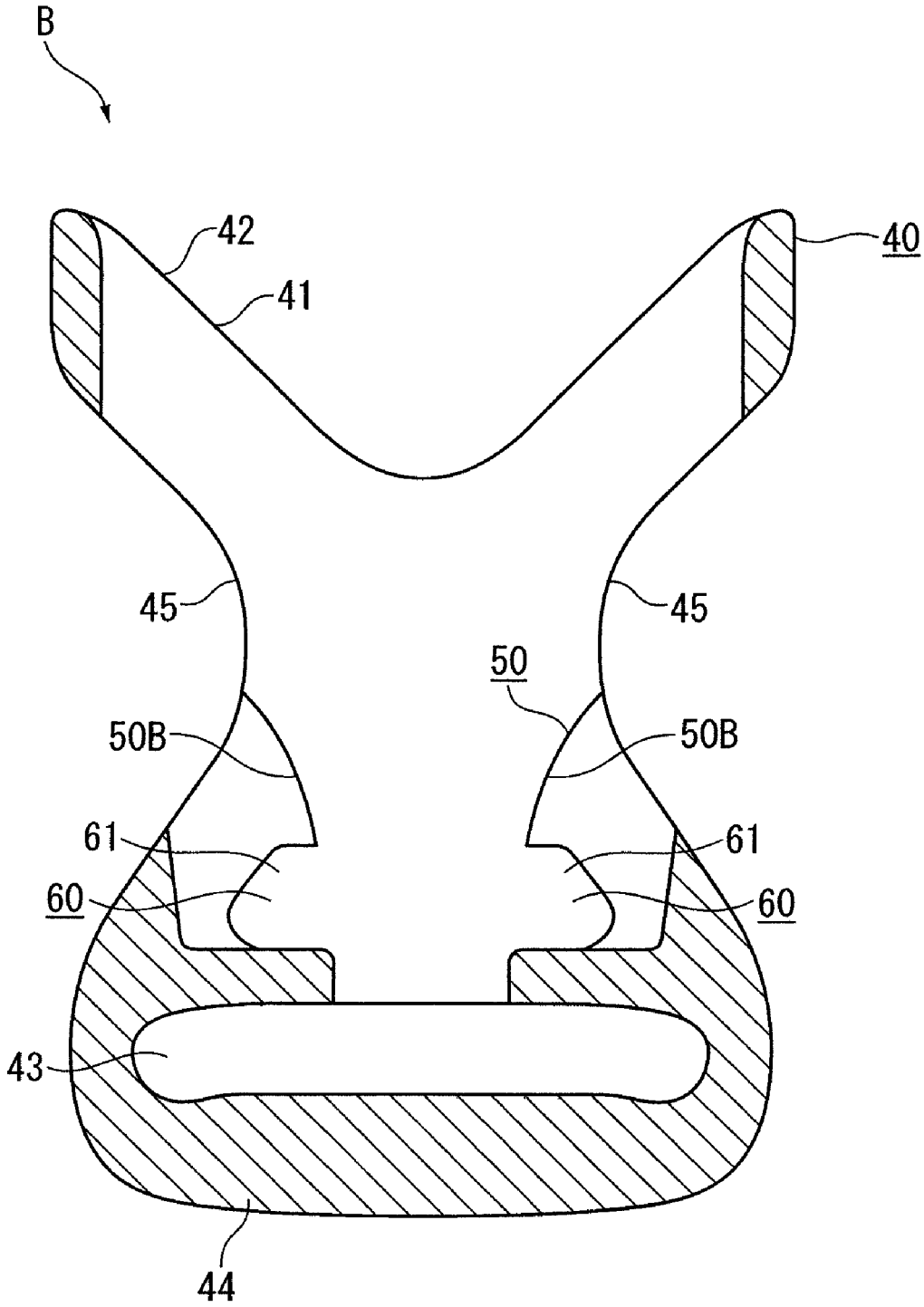
FIG. 11 is a cross-section showing another modification of the female member.
Figure 12A:
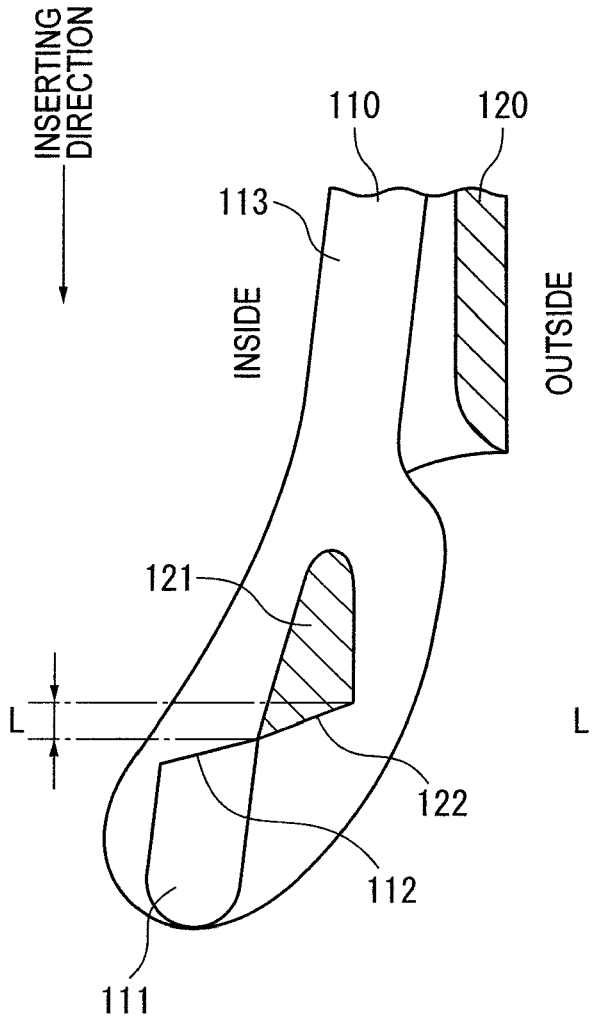
FIG. 12A RELATED ART
FIG. 12A is a view showing a disadvantage of a conventional buckle.
Figure 12B:
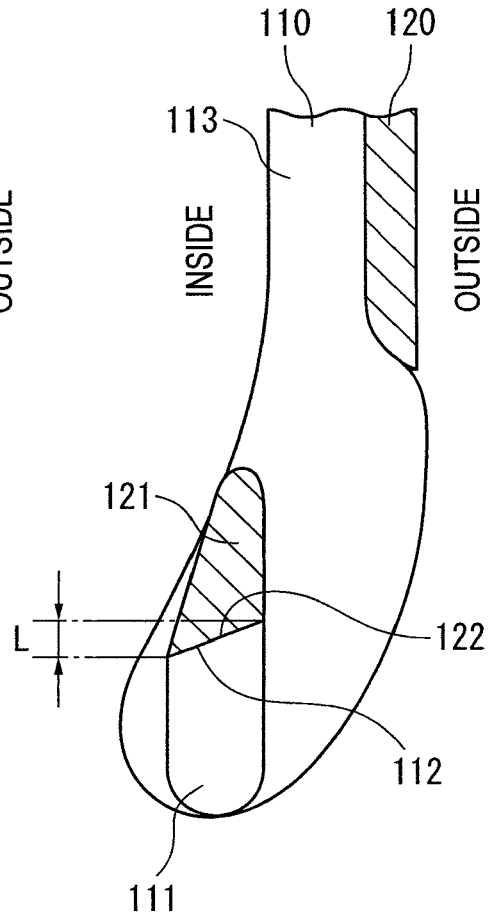
FIG. 12B RELATED ART
FIG. 12B is a view showing a disadvantage of the conventional buckle.

For example, as shown in FIG. 11, a projection 50B that abuts on the engaging portion 30 and elastically deforms the distal ends of the pair of the legs 20 in the direction in which the distal ends come closer to each other and then elastically recovers the distal ends in the direction in which the distal ends get apart from each other may be provided on the inside of the female member body 40.

In the above embodiment, the concave 61 formed on the top wall 40A and the concave 61 formed on the bottom wall 40B are respectively opened at the outer surface of the top wall 40A and the outer surface of the bottom wall 40B, but the arrangement is not limited thereto. For example, as shown in FIG. 11, both or one of the concaves 61 may be formed to have substantially the same depth as those of the projection 50B and the bottom wall of the guide groove 50A without opening at the outer surface of the top wall 40A and the bottom wall 40B. In this way, since no opening is formed on the outer surface of the top wall 40A and the bottom wall 40B, intrusion of foreign materials from the opening can be prevented and the design can be simplified.

In the above embodiment, V-shaped butting portions 14 and 42 are respectively formed on the male member A and the female member B. However, the shape is not limited to the V-shape but may be a flat surface.

In the above embodiment, cord attachment holes 11 and 43 (cord attachment portions) are respectively formed on the male member A and the female member B. However, the female member B may not be provided with the cord attachment hole 43. In other words, the female member body 40 of the female member B may be directly fixed on other members.

Though the cord attachment hole 11A of the male member A exhibits a substantially pentagonal shape that extends toward the projecting direction of the pair of legs 20 while gradually decreasing the width dimension (i.e. a dimension orthogonal to the projecting direction of the legs 20) thereof, the cord attachment hole 11A may be formed in a substantially triangular shape.

Further, a connecting bar may be bridged across the width direction of the cord attachment hole 43 of the female member B to enable length adjustment of the cord.

The cord is not limited to a strip-shaped cord, but may be a thin string with small width.

In the above embodiment, the male member A and the female member B are molded by synthetic resin (injection molding or injection compression molding). However, the male member A and the female member B may be made of metal and the like.

Although preferable embodiments and various modifications have been exemplified above, these embodiments and the modifications may be employed in combination.

The priority application Number JP 2007-175411 upon which this patent application is based is hereby incorporated by reference.

What is claimed is:

1. A buckle, comprising: a male member and a female member, wherein:

the male member comprises:

a base;

a pair of legs that project from the base; and an engaging portion provided on a distal end of each of the pair of the legs to be engageable with the female member;

the female member comprises:

a female member body that includes a top wall and a bottom wall that constitute a top surface and a bottom surface and a pair of side walls that connect the top wall and the bottom wall;

an insertion port into which the pair of the legs of the male member are inserted, the insertion port being provided at an end of the female member body;

a guide that engages the engaging portion and elastically deforms the pair of the legs inserted through the insertion port in a direction in which the engaging portion of the pair of the legs come closer to each other, the guide comprising a tapered guide groove whose width becomes gradually narrower from the insertion port to a depth portion proximate a remote side of the female member body at an inner surface of the top wall and the bottom wall of the female member body; and a pair of engaged portions provided on both the top wall and bottom wall at the depth portion of the guide, the pair of engaged portions displacing the distal ends of the pair of the legs in a direction in which the distal ends of the pair of legs are spaced apart from each other, the pair of engaged portions to be engaged with each of the engaging portions when the engaging portion of the male member is inserted to a predetermined position;

the engaged portions are provided by abutment walls oppositely provided in the direction for the legs to be spaced apart from each other to be abutted with each of the engaging portions; and the abutment walls are respectively formed as a wall surface that extends in a direction in which each of the walls comes closer to each other toward a disengaging direction of the male member.

2. The buckle according to claim 1, wherein an abutment portion of the engaging portion which abuts to each of the abutment walls extends in a direction in which the abutment portion comes closer to each other toward the disengaging direction of the male member and is formed as a wall surface that substantially coincides with the wall surface of each of the abutment walls.

3. The buckle according to claim 1, wherein:

each of the engaged portions comprises an engaged wall that is formed on an insertion port side of the abutment wall and substantially orthogonal to the inserting direction of the male member; and each of the engaging portions comprises an engaging wall that is formed on a base side end of the abutment portion, substantially orthogonally crosses with respect to the disengaging direction of the male member and is engaged with the engaged wall.

4. The buckle according to claim 1, wherein:

a butting portion whose central portion more projects toward a projecting direction of the legs than both side portions where the legs project is provided on the base of the male member; and a butting portion that is provided on a side of the insertion port to closely contact with the butting portion of the male member is provided on the female member.

5. A buckle, comprising: a male member and a female member, wherein:

the male member comprises:

a base;

a pair of legs that project from the base;

an engaging portion provided on a distal end of each of the pair of the legs to be engageable with the female member; and an elastic connecting cord connected between inner sides of the pair of the legs, wherein a central portion of the connection cord is convexly curved toward a frame material;

the female member comprises:

an insertion port into which the pair of the legs of the male member are inserted;

a pair of engaged portions that are engaged with each of the engaging portions at a remote side from the insertion port of the female member when the pair of the legs inserted through the insertion port are inserted to a predetermined position; and a guide that engages the engaging portion and elastically deforms the pair of the legs inserted through the insertion port in a direction in which the engaging portion of the pair of the legs come closer to each other, wherein the guide comprises a tapered guide groove whose width becomes gradually narrower from the insertion port to the remote side from the insertion port of the female member;

wherein the base comprises a frame including a cord attachment hole therein and a central portion, wherein the central portion protrudes between the pair of the legs.

6. The buckle according to claim 5, wherein the frame material is provided as a butting portion against the female member and the butting portion is formed in a V-shape in which a central portion of the frame material protrudes in the projecting direction of the legs relative to the both ends of the frame material.

7. The buckle according to claim 5, wherein the connection cord is formed in a reverse U-shape of which central portion is curved in a convex shape toward the frame material.

* * * * *

UNITED STATES PATENT AND TRADEMARK OFFICE

CERTIFICATE OF CORRECTION

PATENT NO. : 8,112,850 B2
APPLICATION NO. : 12/165901
DATED : February 14, 2012
INVENTOR(S) : Uehara It is certified that error appears in the above-identified patent and that said Letters Patent is hereby corrected as shown below:

Column 5

Line 56, “111B” should read -- 11B --

Signed and Sealed this
Twenty-seventh Day of March, 2012

David J. Kappos

David J. Kappos
*Director of the United States Patent and Trademark Office*